US007011543B2

(12) United States Patent
Hiramoto et al.

(10) Patent No.: US 7,011,543 B2
(45) Date of Patent: Mar. 14, 2006

(54) ELECTRIC CONNECTOR

(75) Inventors: Masayuki Hiramoto, Osaka (JP); Takashi Suyama, Osaka (JP); Terumi Nakashima, Osaka (JP)

(73) Assignee: J.S.T. Mfg, Co., Ltd., Osaka (JP)

( * ) Notice: Subject to any disclaimer, the term of this patent is extended or adjusted under 35 U.S.C. 154(b) by 0 days.

(21) Appl. No.: 10/950,476

(22) Filed: Sep. 28, 2004

(65) Prior Publication Data

US 2005/0070151 A1 Mar. 31, 2005

(30) Foreign Application Priority Data

Sep. 30, 2003 (JP) ..... 2003-340934

(51) Int. Cl.
*H01R 13/58* (2006.01)

(52) U.S. Cl. ..... 439/405; 439/942

(58) Field of Classification Search ..... 439/942, 439/449, 399, 960, 407, 385, 405, 456, 719
See application file for complete search history.

(56) References Cited

U.S. PATENT DOCUMENTS 4,101,189 A * 7/1978 Moser et al. ..... 439/405

FOREIGN PATENT DOCUMENTS

| | | | |
|---|---|---|---|
| JP | 2001-203008 | A | 2/2001 |
| JP | 2001-176570 | A | 6/2001 |
| JP | 2001-176571 | A | 6/2001 |
| JP | 2001-176603 | A | 6/2001 |
| JP | 2001-351727 | A | 12/2001 |
| JP | 2002-260803 | A | 9/2002 |

* cited by examiner

*Primary Examiner*—P. Austin Bradley
*Assistant Examiner*—Phuongchi Nguyen
(74) *Attorney, Agent, or Firm*—Rader, Fishman & Grauer PLLC

(57) ABSTRACT

An electric connector having a housing in which there are disposed, side by side, a plurality of wire holding portions for holding the insulations of insulated wires. Each wire holding portion has: a pair of wire holding pieces disposed as facing each other to form a wire holding groove; and wire hold-down pieces not only for guiding, in the vertical direction, the insertion of the insulated wire into the wire holding groove, but also for preventing the insulated wire from coming off from the wire holding groove. The plurality of wire holding portions has: a first wire holding portion having wire hold-down pieces at a first wire hold-down position; and a second wire holding portion disposed adjacent to the first wire holding portion, and having wire hold-down pieces at a second wire hold-down position different from the first wire hold-down position.

10 Claims, 9 Drawing Sheets

ELECTRIC CONNECTOR

BACKGROUND OF THE INVENTION

1. Field of the Invention

The present invention relates to an electric connector having a retention structure for preventing an insulated wire from coming off in the vertical direction at right angles to the wire axial direction.

2. Description of Related Art

A connector attached to an insulated wire has a resin housing and a contact (terminal metal fitting) secured to the housing. When there is used an insulation displacement contact having the arrangement that a slot for holding the core wire portion of an insulated wire is formed between a pair of insulation displacement blades for breaking up the insulation of the insulated wire, the contact and the core wire portion of the insulated wire can electrically be connected to each other merely by pushing the insulated wire into the slot of the insulation displacement contact. A connector using such an insulation displacement contact is called an insulation displacement connector.

In an insulation displacement connector, the retention force in the axial direction of an insulated wire (axial retention force) is obtained by nipping the core wire portion by the contact. However, the slot of the insulation displacement contact is opened in the vertical direction at right angles to the axial direction of the insulated wire. Therefore, when the wire is held only by the contact, the retention force in the vertical direction above-mentioned (orthogonal retention force) is insufficient. Accordingly, the housing has a retention structure for the insulation of the insulated wire.

More specifically, the housing is provided, in its position out of alignment with the contact in the axial direction of the insulated wire, with a wire holding groove for housing an insulated wire. Formed at the opening edges of the wire holding groove are wire hold-down pieces or strain relief pieces which project inwardly of the wire holding groove. At the same time when an insulated wire is mounted on an insulation displacement contact, the insulation of the wire is pushed to the wire hold-down pieces. As a result, the wire hold-down pieces are resiliently deformed and the wire holding groove is resiliently expanded and deformed. When the insulated wire gets over the wire hold-down pieces and is then housed in the wire holding groove, the wire hold-down pieces and the wire holding groove are restored in shape. Accordingly, when an external force is thereafter exerted, to the wire held in the wire holding groove, in the direction in which the wire is pulled out from the wire holding groove, the insulated wire is held within the wire holding groove under the action of the wire hold-down pieces. Thus, provision is made such that a sufficient orthogonal retention force is obtained (Japanese Patent Laid-Open Publication 2001-203008).

A connector to which a plurality of wires are connected, has contacts and wire holding grooves which respectively correspond to these wires. A plurality of wire holding grooves are formed in a row. However, when a plurality of wires are simultaneously mounted on the connector, the plurality of wire holding grooves are simultaneously expanded and opened. This causes the housing to be remarkably bent and deformed.

A connector used in a small-size device such as a digital still camera, a video camera, a cellular phone, a PDA (personal digital assistant) and the like, is extremely miniaturized in size, and is a multi-pole connector having a number of poles. When such a miniaturized and multi-pole connector is remarkably bent and deformed as above-mentioned, this involves the likelihood that the housing is broken in the step of mounting the insulated wires.

Further, in a miniaturized multi-pole connector, it can hardly be expected to resiliently deform the wire hold-down pieces due to their marginal miniaturization. Further, the insulations of insulated wires connected to the miniaturized multi-pole connector are very low in thickness. Thus, the deformation of the insulations can hardly be expected. Accordingly, the insertion of the insulated wires into the wire holding grooves has to rely solely on the resilient expansion and deformation of the wire holding grooves. Therefore, when the insulated wires are press-fitted, the housing is remarkably bent and deformed. This involves the likelihood that the housing is broken.

On the other hand, unless the housing is sufficiently bent and deformed, a plurality of insulated wires cannot be inserted into the wire holding grooves.

This dilemma can be solved by adopting the wire insertion method disclosed in Japanese Patent Laid-Open Publication 2002-260803. According to this prior art, the insulated wires are inserted in two steps including a first insertion step of pushing wires every other pole collectively into the housing by a punch, and a second insertion step of pushing wires every another pole collectively into the housing by another punch. It is there fore possible to insert the insulated wires into the housing without the housing remarkably bent and deformed at each insertion step.

According to this method, however, the wire insertion has to be divided into two steps, thus lowering the productivity. Further, a special punch has to be provided for holding down the wires every other pole.

SUMMARY OF THE INVENTION

It is an object of the present invention to provide an electric connector in which a plurality of insulated wires are respectively held by a plurality of wire holding portions with excellent productivity without the housing remarkably bent and deformed.

The present invention relates to an electric connector having a housing in which there are disposed, side by side, a plurality of wire holding portions for holding the insulations of insulated wires of which core wire portions are covered by the insulations. According to the present invention, each wire holding portion comprises: a pair of wire holding pieces disposed as facing each other to form a wire holding groove for receiving an insulated wire; and wire hold-down pieces or strain relief pieces not only for guiding, in the vertical direction at right angles to the axial direction of the insulated wire, the insertion of the insulated wire into the wire holding groove, but also for preventing the insulated wire from coming off from the wire holding groove. The plurality of wire holding portions comprise: a first wire holding portion having wire hold-down pieces arranged to hold an insulated wire in the wire holding groove at a first wire hold-down position with respect to the axial direction of the insulated wire; and a second wire holding portion disposed adjacent to the first wire holding portion, and having wire hold-down pieces arranged to hold an insulated wire in the wire holding groove at a second wire hold-down position different from the first wire hold-down position with respect to the axial direction of the insulated wire.

According to the arrangement above-mentioned, in the adjacent first and second wire holding portions, the respective wire hold-down positions by the wire hold-down pieces are misaligned with each other in the axial direction of the insulated wires. Accordingly, even though wires are simultaneously inserted into the wire holding grooves of the first and second wire holding portions, this does not cause the housing to be greatly deformed. More specifically, the position where the pair of wire holding pieces forming the first wire holding portion are resiliently expanded and opened when an insulated wire is inserted into the first wire holding portion in the vertical direction substantially at right angles to the wire axial direction, is shifted, in the insulated wire axial direction, from the position where the pair of wire holding pieces forming the second wire holding portion are resiliently expanded and opened when an insulated wire is inserted into the second wire holding portion. Accordingly, the expanding and opening of the wire holding pieces (the expanding and opening of the wire holding groove) of the first wire holding portion, and the expanding and opening of the wire holding pieces (the expanding and opening of the wire holding groove) of the second wire holding portion, can simultaneously be carried out without any interference with each other. As the result, even though insulated wires are simultaneously inserted respectively into the wire holding grooves of the first and second wire holding portions, this does not cause the housing to be greatly deformed. In other words, even though the housing cannot be resiliently greatly deformed due to its structure (for example, when the housing is very small), insulated wires can simultaneously be inserted into the first and second wire holding portions without any special difficulty.

Accordingly, in the less number of times (for example, one time), a plurality of insulated wires can respectively be inserted in and held by the plurality of wire holding portions.

The wire hold-down pieces may be formed as projecting as if closing portions of the wire holding grooves at the lateral edges thereof.

The plurality of wire holding portions may comprise: the first wire holding portion above-mentioned in plural number; and the second wire holding portion above-mentioned in plural number. These first and second wire holding portions may be alternately disposed in the housing.

In such a case, the wire hold-down pieces are disposed in zigzags.

According to the arrangement above-mentioned, since the first and second wire holding portions are alternately disposed, the adjacent wire holding portions do not interfere with each other at any position thereof as to the expansion and deformation of the wire holding pieces. This enables, for example, all the insulated wires to be simultaneously inserted into the wire holding portions, respectively, thus remarkably improving the productivity.

The plurality of wire holding portions are preferably arranged such that three arbitrary adjacent wire holding portions comprise at least one first wire holding portion above-mentioned and at least one second wire holding portion above-mentioned.

According to the arrangement above-mentioned, as to three arbitrary adjacent wire holding portions, there is no possibility of three first wire holding portions being disposed in succession, and there is no possibility of three second wire holding portions being disposed in succession. More specifically, there is no possibility of three wire holding portions having wire hold-down pieces which hold wires at the same position in the axial direction of the insulated wire. For example, even though two first wire holding portions are adjacent to each other, the second wire holding portion is positioned adjacent to the first wire holding portions. In such a case, when inserting insulated wires, two adjacent first wire holding portions interfere with each other as to the resilient deformation of the wire holding pieces in one direction, but do not interfere with each other as to the resilient deformation of the wire holding pieces in the other direction. Accordingly, the insulated wires can successfully be mounted without the housing greatly deformed and without the housing required to be greatly deformed.

Preferably, the plurality of wire holding portions further comprise a third wire holding portion which is disposed adjacent to the first or second wire holding portion, and which has wire hold-down pieces arranged to hold an insulated wire in the wire holding groove at a third wire hold-down position different from the first and second wire hold-down positions with respect to the axial direction of the insulated wire.

According to the arrangement above-mentioned, the wire hold-down positions are dispersed at three different positions with respect to the axial direction of the insulated wire. This further reduces the mutual interference, as to the expansion and deformation, of the wire holding pieces forming the wire holding portions, thus further restraining the housing from being deformed at the time when insulated wires are pressed. Further, even though the housing can be deformed only in a very small amount, the insulated wires can successfully be inserted.

The present invention may be arranged such that the plurality of wire holding portions comprise the first wire holding portion above-mentioned in plural number, the second wire holding portion above-mentioned in plural number, and the third wire holding portion above-mentioned in plural number, and that the first, second and third wire holding portions are disposed, for example cyclically, such that the wire holding portions of the same type are not disposed adjacent to each other. Accordingly, the wire hold-down pieces can be arranged in zigzags in three rows. This not only effectively restrains the housing from being deformed, but also enables the insulated wires to be smoothly mounted without the housing required to be greatly deformed.

Preferably, each wire hold-down piece has: a guiding inclined face which faces the outside of a wire holding groove and which is arranged to guide an insulated wire into the wire holding groove; and a wire regulating face which faces the inner bottom of the wire holding groove. More specifically, the guiding inclined face is a face inclined from a tip edge of the wire holding piece toward the inner bottom of the wire holding groove, and the wire regulating face is a face substantially at right angles to the wire insertion direction or a face inclined from the edge connected to the wire holding piece toward the inner bottom of the wire holding groove.

Preferably, the housing comprises contact holding portions which are disposed at the inner parts of the wire holding grooves and which hold contacts (terminal metal fittings) to be coupled and electrically connected to the core wire portions of the insulated wires, the contacts being held by the contact holding portions. Preferably, each of the contacts is an insulation displacement contact having a pair of insulation displacement blades which form a slot for receiving the core wire portion of an insulated wire. According to the arrangement above-mentioned, when an insulated wire is pressed into the slot, the insulation displacement blades tear the insulation, causing the inside core wire portion to come in contact with the insulation displacement blades. This achieves the electric connection between the core wire portion and the contact.

Wire hold-down pieces may be formed at each pair of wire holding pieces defining a wire holding groove. At this time, it is enough that at least one of a pair of wire hold-down pieces of the first wire holding portion, is positionally shifted, in the axial direction of the insulated wire, from at least one of a pair of wire hold-down pieces of the second wire holding portion.

The plurality of wire holding portions may hold a plurality of insulated wires in parallel to one another, for example in a predetermined plane.

The plurality of wire holding portions may be arranged such that each wire holding piece is shared with adjacent wire holding portions. More specifically, each wire holding piece may define parts of a pair of adjacent wire holding grooves.

These and other features, objects and advantages of the present invention will be more fully apparent from the following detailed description set forth below when taken in conjunction with the accompanying drawings.

DESCRIPTION OF THE PREFERRED EMBODIMENTS

Figure 1:
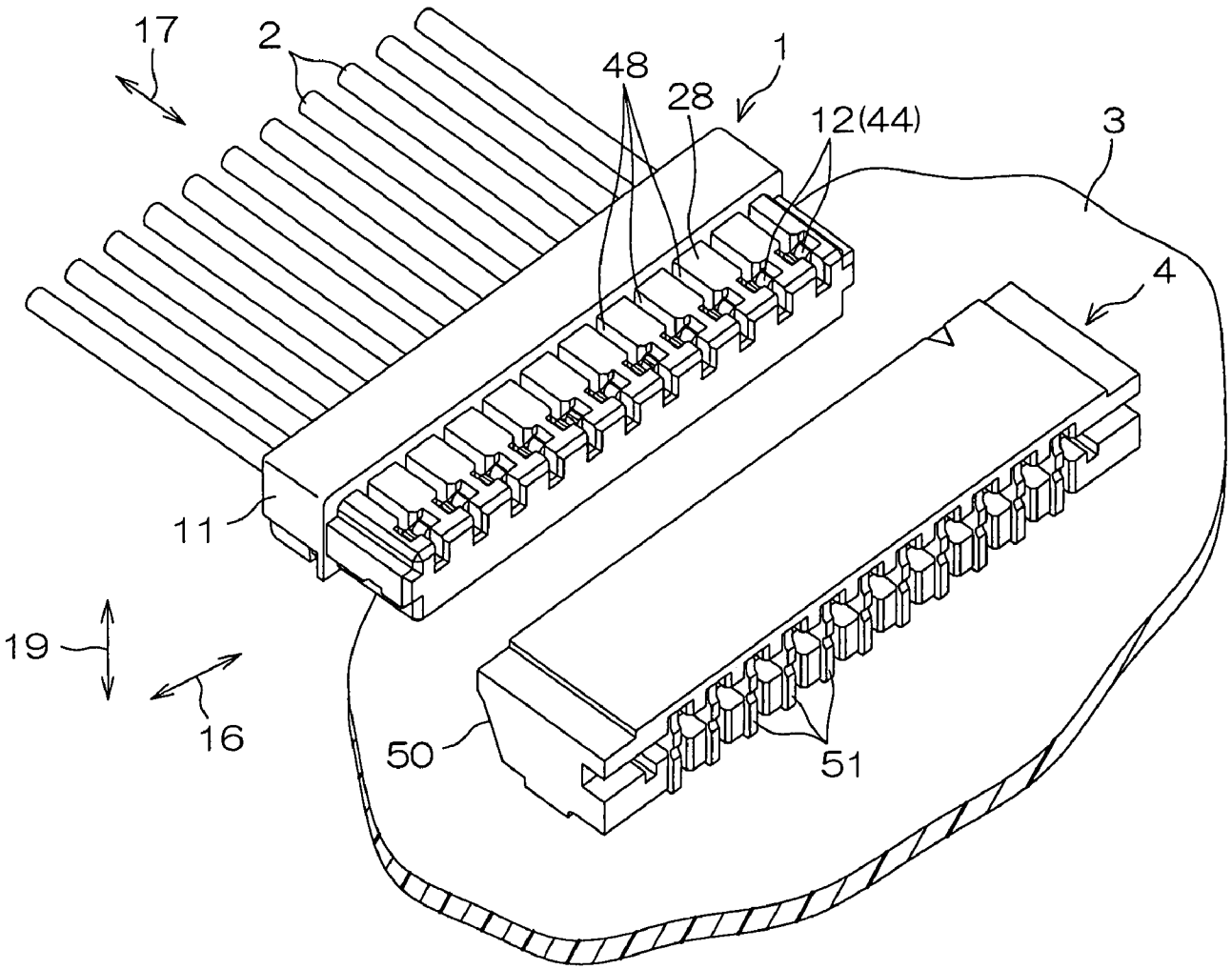
FIG. 1 is a perspective view illustrating how to use an electric connector according to an embodiment of the present invention.

FIG. 1 is a perspective view illustrating how to use an electric connector according to an embodiment of the present invention. The electric connector 1 according to this embodiment is a wire-side connector connected to a plurality of insulated wires 2. This wire-side connector 1 can be connected, for example, to a board-side connector 4 surface-mounted on a printed circuit board 3. When the wire-side connector 1 is connected to the board-side connector 4, the insulated wires 2 are electrically connected to the printed circuit board 3.

Figure 2:
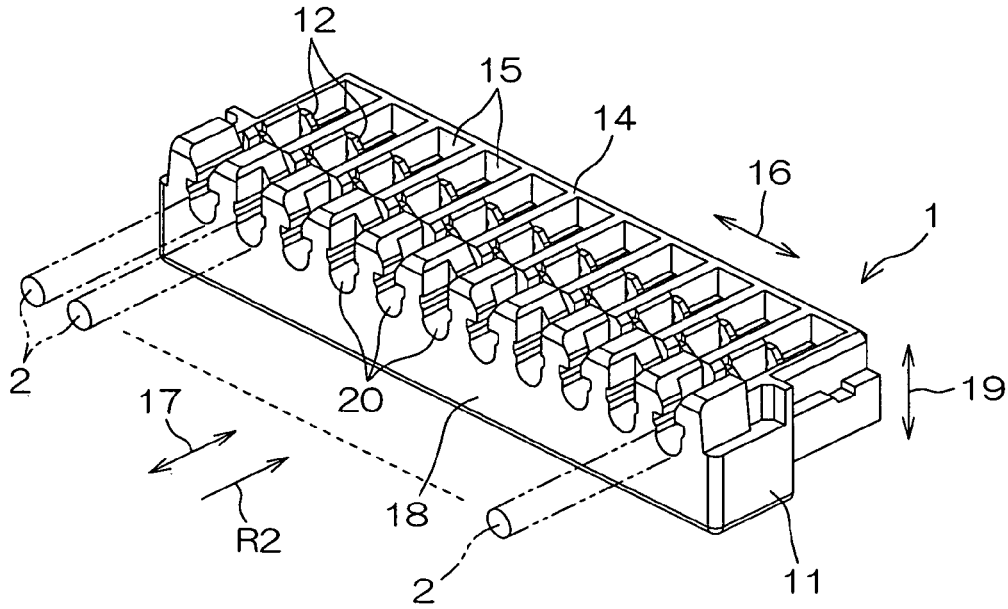
FIG. 2 is a perspective view of the wire-side connector with its actual upside turned down, when viewed from the rear side to which insulated wires are to be connected.
Figure 3:
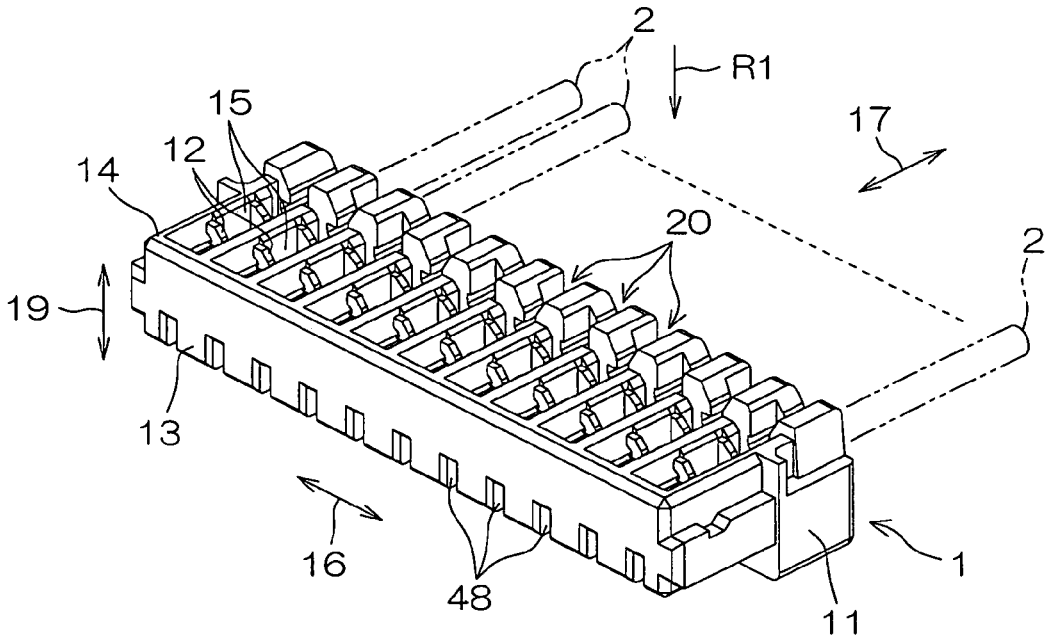
FIG. 3 is a perspective view of the wire-side connector with its actual upside turned down, when viewed from the front side (from the board-side connector)
Figure 4:
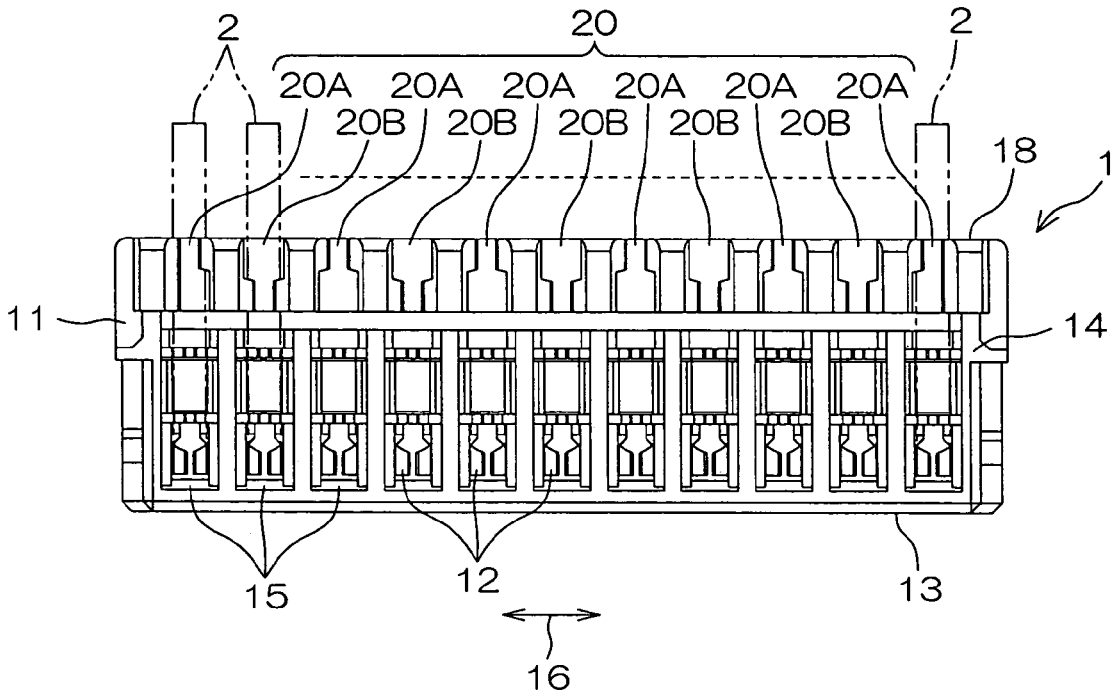
FIG. 4 is a bottom view of the wire-side connector as viewed from the direction of an arrow R1 in FIG. 3.

FIG. 2 and FIG. 3 are perspective views of the wire-side connector 1 with its actual upside turned down. FIG. 2 shows the wire-side connector 1 as viewed from the rear side to which the insulated wires 2 are to be connected, while FIG. 3 shows the wire-side connector 1 as viewed from the front side (from the board-side connector 4). FIG. 4 is a bottom view of the wire-side connector 1 when viewed from the direction of an arrow R1 in FIG. 3.

This wire-side connector 1 comprises a housing 11 made of a synthetic resin molded article, and insulation displacement contacts (terminal metal fittings) 12 press-fitted into and held by the housing 11. This housing 11 is formed substantially in a rectangular parallelepiped box. The housing 11 is provided at the front face 13 side thereof with a plurality of groove-shape contact holding portions 15 which are opened in the bottom (the side opposite to the printed circuit board 3 when actually used) 14 and which are arranged along the widthwise direction 16 of the housing 11.

The contact holding portions 15 are formed along the axial direction 17 of the insulated wires 2 at right angles to the width wise direction 16. The contact holding portions 15 are arranged to hold insulation displacement contacts 12 which can be press-fitted into the contact holding portions 15 from the bottom face 14 side of the housing 11.

At positions nearer to the rear face 18 of the housing 11 rather than to the contact holding portions 15, a plurality of wire holding portions 20 respectively corresponding to the contact holding portions 15, are formed along the widthwise direction 16.

Figure 5:
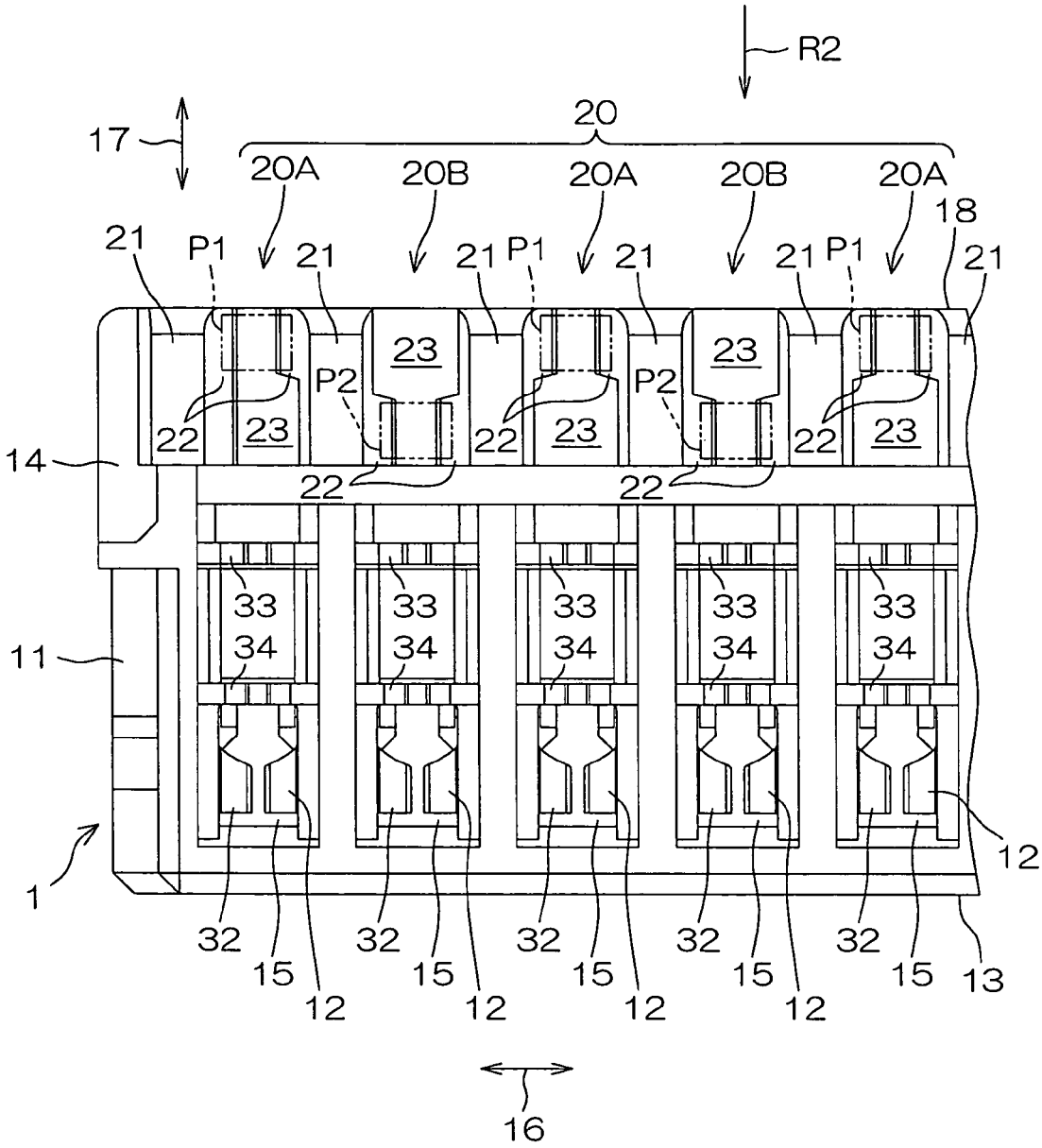
FIG. 5 is a bottom view illustrating, in enlargement, a portion of the arrangement shown in FIG. 4.
Figure 6:
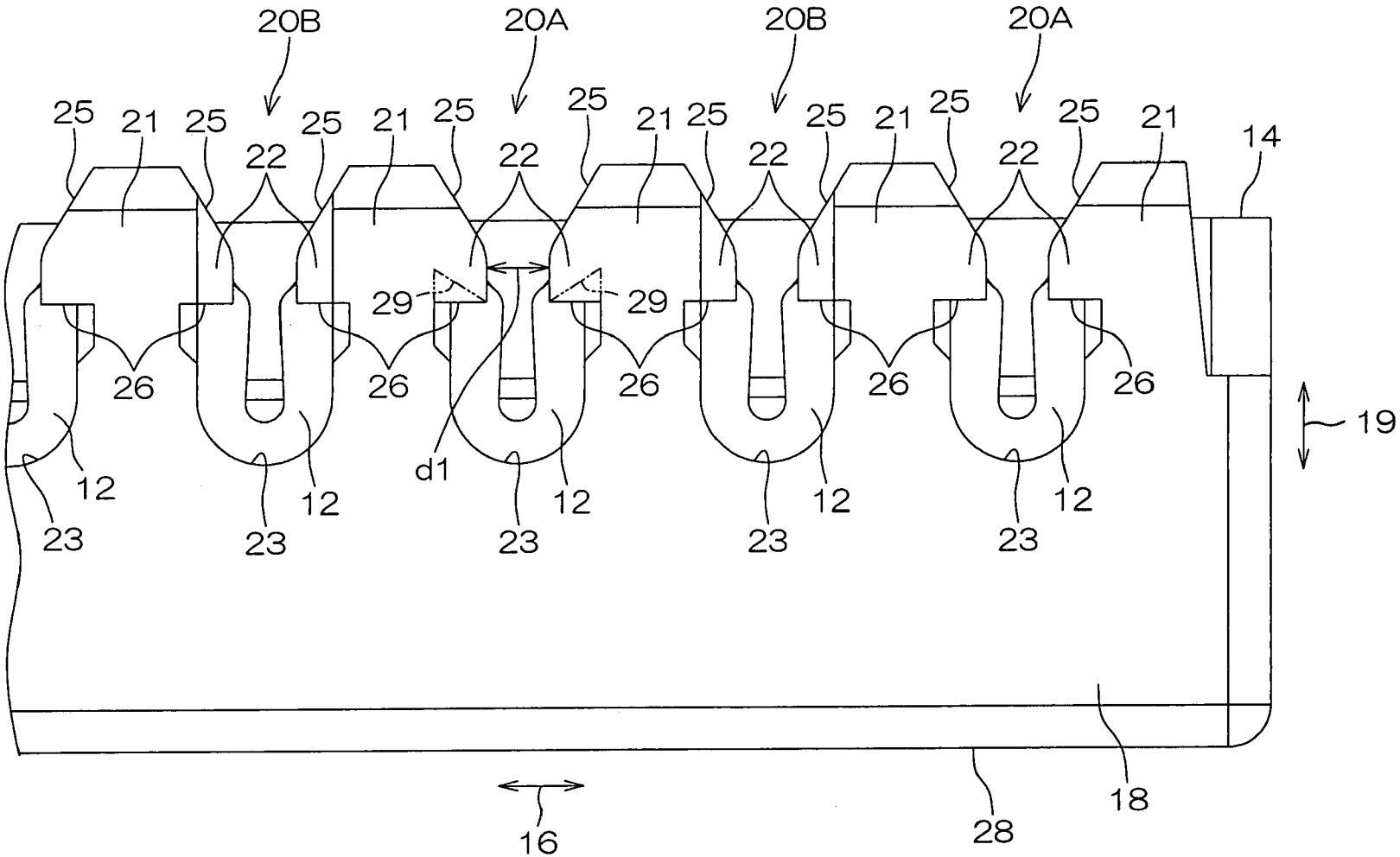
FIG. 6 is a back view illustrating, in enlargement, the arrangement of wire holding portions as viewed from the direction of an arrow R2 in FIGS. 2 and 5.

FIG. 5 is a bottom view illustrating, in enlargement, a portion of the arrangement shown in FIG. 4. FIG. 6 is a back view illustrating, in enlargement, the arrangement of the wire holding portions 20 as viewed from the direction of the arrow R2 in FIGS. 2 and 5. Each wire holding portion 20 has a pair of oppositely disposed wire holding pieces 21 and wire hold-down pieces or strain relief pieces 22 which project from the tip ends of the wire holding pieces 21. The wire holding pieces 21 are formed like walls extending along the height direction 19 of the housing 11. Each pair of opposite wire holding pieces 21 form a wire holding groove 23 for housing and holding the insulation of an insulated wire 2. Each wire holding piece 21 is shared with adjacent two wire holding portions 20. One surface and the other surface of each wire holding piece 21 respectively define portions of the wire holding grooves 23 of adjacent wire holding portions 20. The wire holding grooves 23 are opened in the rear face 18 of the housing 11 and also opened in the bottom face 14 of the housing 11.

The wire hold-down pieces 22 project, from the tip edges (the lower end edges in the actual usage state) of the wire holding pieces 21, as if covering the wire holding grooves 23. Each wire hold-down piece 22 has a guiding inclined face 25 for guiding the insertion of an insulated wire 2 from the bottom face 14 side, and a wire regulating face 26 for preventing the insulated wire 2 housed in the wire holding groove 23 from coming out toward the bottom face 14. The guiding inclined faces 25 face the outside of the wire holding grooves 23 and are inclined from the tips of the wire holding pieces 21 toward the inner parts of the wire holding grooves 23. The wire regulating faces 26 face the inner parts of the wire holding grooves 23 and are flat faces substantially parallel to the bottom face 14 of the housing 11. As shown by chain double-dashed lines 29, the wire regulating faces 26 may be inclined from the edges connected to the wire holding pieces 21 toward the inner parts of the wire holding grooves 23. However, when the wire-side connector 1 is very small in size, it is often difficult to process the wire regulating faces 26 into such inclined faces.

In each wire holding portion 20, the wire hold-down pieces 22 project, substantially symmetrically with each other, from the tips of a pair of opposite wire holding pieces 21 into the wire holding groove 23. The distance d1 between each pair of wire hold-down pieces 22 is defined as smaller than the outer diameter of each insulated wire 2 and as slightly larger than the diameter of the core wire portion of each insulated wire 2. Accordingly, when pressing the insulated wires 2 into the wire holding grooves 23, the insulated wires 2 are first guided by the guiding inclined faces 25 and then introduced into the inner parts of the wire holding grooves 23 while the pairs of wire holding pieces 21 are resiliently expanded and deformed. When the insulated wires 2 go past the wire hold-down pieces 22 and reach the inner parts of the wire holding grooves 23, the wire holding pieces 21 are restored to the original postures, and the wire regulating faces 26 become opposite to the insulated wires 2 in the wire holding grooves 23. This prevents the insulated wires 2 from coming off from the wire holding grooves 23, thus assuring a sufficient orthogonal retention force.

As shown in FIGS. 4 and 5, the wire holding portions 20 are classified into first wire holding portions 20A and second wire holding portions 20B, based on first and second wire hold-down positions P1, P2 which are the actuating positions of the wire hold-down pieces 22. More specifically, in each first wire holding portion 20A, a pair of wire hold-down pieces 22 face to each other at a position nearer to the rear face 18 of the housing 11, this position serving as the first wire hold-down position P1. On the other hand, in each second wire holding portion 20B, a pair of wire hold-down pieces 22 face to each other at a position nearer to the contact holding portions 15, this position serving as the second wire hold-down position P2. More specifically, the wire hold-down positions P1 of the first wire holding portions 20A and the wire hold-down positions P2 of the second wire holding portions 20B, are out of aligned with each other with respect to the axial direction 17 of the insulated wires 2.

The plurality of wire holding portions 20 comprise the first wire holding portion 20A above-mentioned in plural number and the second wire holding portion 20B above-mentioned in plural number, these portions 20A, 20B being alternately arranged. Accordingly, the respective wire hold-down positions of adjacent wire holding portions 20, are shifted back and forth along the axial direction of the insulated wires 2, and are there fore arranged in zigzags as a whole.

When a plurality of insulated wires 2 are collectively pushed into the plurality of wire holding portions 20 by a punch of a press machine, the pairs of wire hold-down pieces 22 of the first wire holding portions 20A receive the pushing forces from the insulated wires 2. Accordingly, the pairs of wire holding pieces 21 respectively connected to the pairs of wire hold-down pieces 22, are resiliently expanded and opened, and deformed toward the insides of the wire holding grooves 23 of the adjacent second wire holding portions 20B. In these adjacent second wire holding portions 20B, the wire holding pieces 21 are similarly resiliently expanded and opened at positions shifted, along the axial direction 17 of the insulated wires 2, from the positions where the wire holding pieces 21 of the first wire holding portions 20A are resiliently expanded and opened. That is, the wire holding pieces 21 of the adjacent second wire holding portions 20B are deformed toward the insides of the wire holding grooves 23 of the adjacent first wire holding portions 20A. More specifically, the facing positions of the wire hold-down pieces 22 of the first wire holding portion 20A and the facing positions of the wire hold-down pieces 22 of the second wire holding portions 20B, are out of alignment with each other, back and forth, in the axial direction of the insulated wires 2. Therefore, the deformations of the wire holding pieces 21 occurred at the time when the insulated wires 2 are pressed, can be absorbed by the mutual wire holding grooves 23.

In each of the end wire holding portions 20, the outer wire hold-down piece 22 in the housing widthwise direction 16 is formed as projecting from the wire holding piece 21 substantially throughout the length of the wire holding groove 23, while the inner wire hold-down piece 22 is formed only at a limited zone nearer to the housing rear face 18 (or a limited zone nearer to the contact holding portion 15). Thus, the pair of outer and inner wire hold-down pieces 22 face each other only at this limited zone. The orthogonal retention force for the insulated wire 2 is produced solely by this zone where the pair of wire hold-down pieces 22 face each other.

Figure 7:
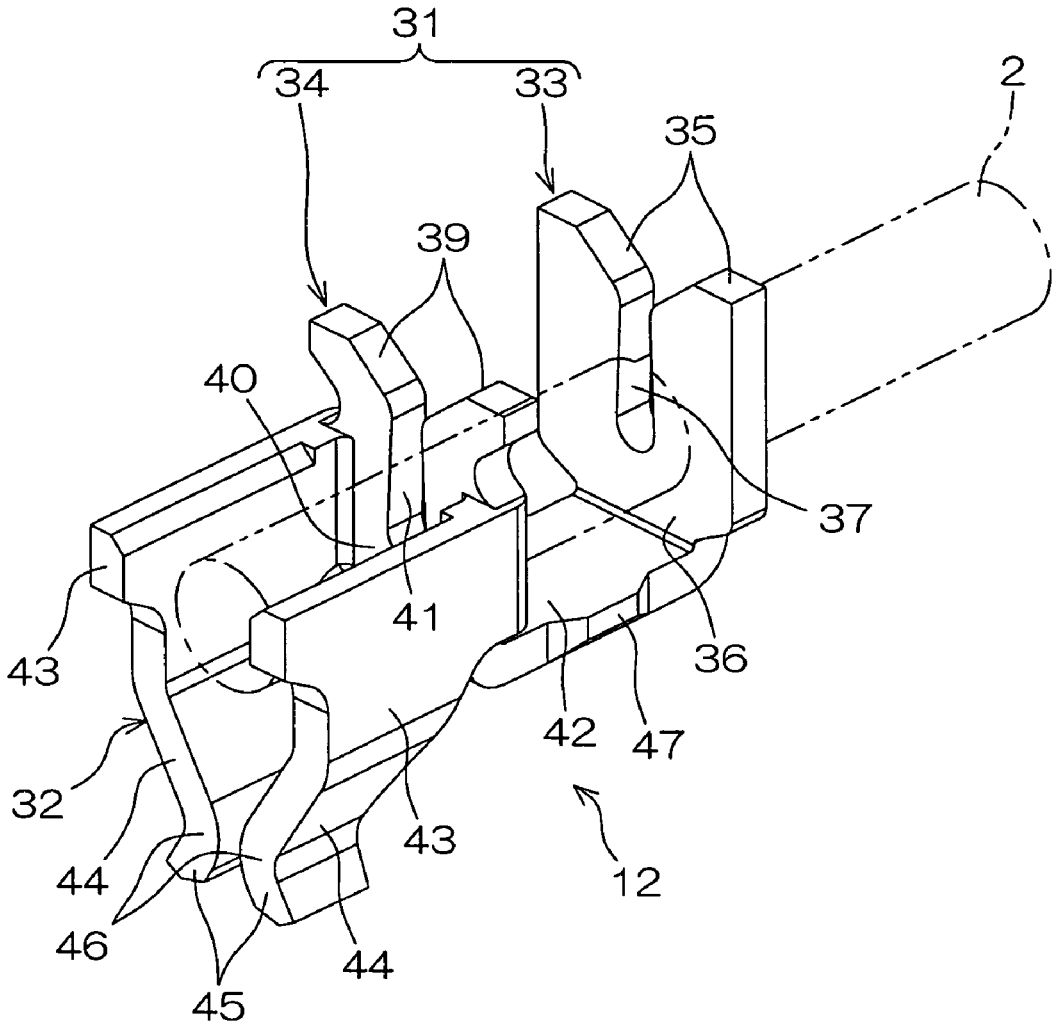
FIG. 7 is a perspective view of an insulation displacement contact of the wire-side connector.

FIG. 7 is a perspective view of an insulation displacement contact 12. The insulation displacement contact 12 is formed in a unitary structure by punching or bending a metallic plate (for example, a plated copper plate). The insulation displacement contact 12 is provided, at its rear portion corresponding to the housing rear face 18 side, with an insulation displacement part 31 to which an insulated wire 2 is coupled. Also, the insulation displacement contact 12 is provided, at its front portion, with contact portions 32 which come in contact with a contact of the board-side connector 4.

The insulation displacement part 31 has first and second insulation displacement portions 33, 34 separated from each other back and force. The first insulation displacement portion 33 has a pair of insulation displacement blades 35, and a connection portion 36 for holding the pair of insulation displacement blades 35 such that they face each other. Formed between the insulation displacement blades 35 is a slot 37 in which the core wire portion of an insulated wire 2 is pressed and held. Likewise, the second insulation displacement portion 34 has a pair of insulation displacement blades 39 defining a slot 41, and the pair of insulation displacement blades 39 are connected to each other at their base portions by a connection portion 40. The connection portions 36, 40 are connected to each other by a bottom plate 42. The bottom plate 42 is provided at each lateral side thereof with a laterally projecting press-fitting projection 47. The press-fitting projections 47 are arranged such that when the insulation displacement contact 12 is pressed into the corresponding contact holding portion 15 of the housing 11, the press-fitting projections 47 bite into the inner walls of the contact holding portion 15 such that the insulation displacement contact 12 is held by the contact holding portion 15.

Contact portions 32 have (i) a pair of lateral plates 43 forwardly extending, in parallel to each other, from the outer edges of the insulation displacement blades 39 of the second insulation displacement portion 34, and (ii) a pair of resilient nipping pieces 44 extending, from the lateral plates 43, in the vertical direction at right angles to the axial direction of the insulated wire 2. The resilient nipping pieces 44 extend, from the lateral plates 43, in an inclined and tapering manner, and are provided at the tips thereof with guiding inclined portions 45 which are inclined in expanding and opening directions from the mutual closest portions of the resilient nipping pieces 44. The mutual closest portions of the pair of resilient nipping pieces 44 serve as contact points 46 arranged to resiliently hold the corresponding contact of the board-side connector 4.

As shown in FIG. 1, the housing 11 is provided in the top face 28 thereof with contact receiving grooves 48 for receiving the contacts of the board-side connector 4, the grooves 48 being formed in the axial direction 17 of the insulated wires 2. Provision is made such that the resilient nipping pieces 44 of the insulation displacement contacts 12 are inserted into the contact receiving grooves 48.

Figure 8A:
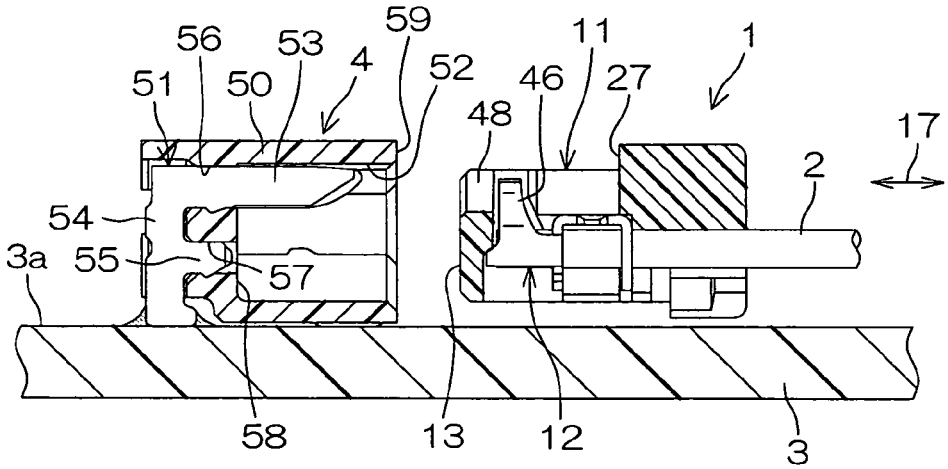
FIG. 8(*a*) is a section view illustrating the wire-side connector and the board-side connector before fitting to each other, and FIG. 8(*b*) is a section view illustrating the wire-side connector and the board-side connector fitted to each other.
Figure 8B:
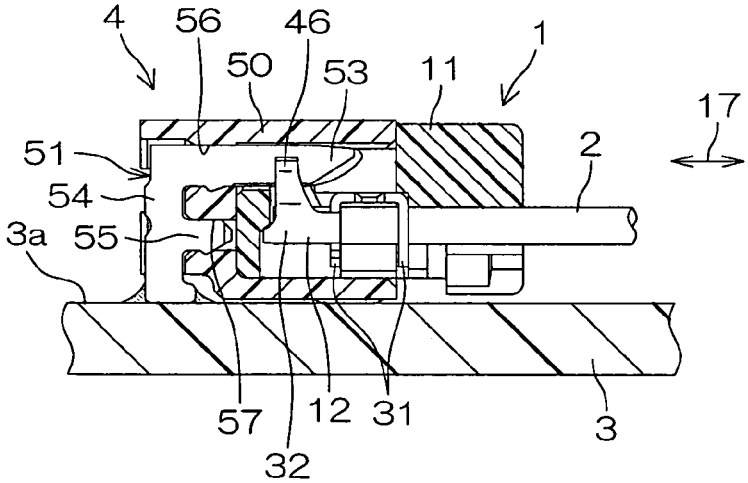

FIG. 8(*a*) is a section view illustrating the wire-side connector 1 and the board-side connector 4 before fitting to each other, and FIG. 8(*b*) is a section view illustrating the wire-side connector 1 and the board-side connector 4 fitted to each other. The board-side connector 4 has a housing 50 made of a resin molded article, and a plurality of contacts 51 pressed into and held by the housing 50. The housing 50 has a fitting hole 52 opened in the front side opposite to the wire-side connector 1, and the front portion of the housing 11 of the wire-side connector 1 is to be fitted into this fitting hole 52.

The plurality of contacts 51 are pressed into the housing 50 from the rear side thereof, and held by the housing 50 such that they are disposed side by side in the direction parallel to the insertion direction of the wire-side connector 1. Each contact 51 has (i) a contact portion 53 projecting into the fitting hole 52, (ii) a joint portion 54 which downwardly extends from the rear end of the contact portion 53 toward the mounting face 3*a* of the printed circuit board 3 and which is soldered to the surface of the printed circuit board 3, and (iii) a press-fitting piece 55 which projects forwardly from an intermediate portion of the joint portion 54 and which is pressed into a press-fitting hole 57 in the housing 50. Each contact 51 is pressed into and fixed to the housing 50 when the contact portion 53 is pressed into a terminal insertion hole 56 and the press-fitting piece 55 is pressed into the press-fitting hole 57.

When the wire-side connector 1 is inserted into the board-side connector 4, the front face 13 of the housing 11 of the wire-side connector 1 comes in contact with the inner bottom face 58 of the fitting hole 52 of the board-side connector 4, or a step portion 27 of the housing 11 comes in contact with an opening edge 59 of the housing 50 of the board-side connector 4. This regulates the relative positions, in the axial direction 17 of the insulated wires 2, of the wire-side connector 1 and the board-side connector 4. When the front portion of the housing 11 of the wire-side connector 1 is fitted into the fitting hole 52 of the board-side connector 4, the contact portions 53 of the contacts 51 of the board-side connector 4 are introduced, as accurately positioned, into the contact receiving grooves 48 of the wire-side connector 1. Thus, the contact portions 53 are resiliently held, in the contact receiving grooves 48, by the pairs of contact points 46 of the insulation displacement contacts 12. This achieves the electric connection between the contacts 12 and 51, causing the insulated wires 2 to be electrically connected to the printed circuit board 3.

Figure 9A:
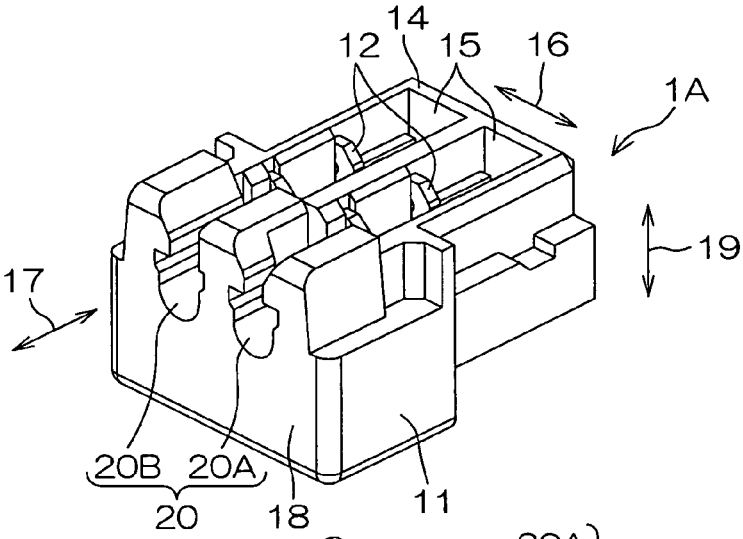
FIG. 9(*a*), FIG. 9(*b*) and FIG. 9(*c*) are views illustrating the arrangement of a wire-side connector according to a modification of the embodiment above-mentioned.
Figure 9B:
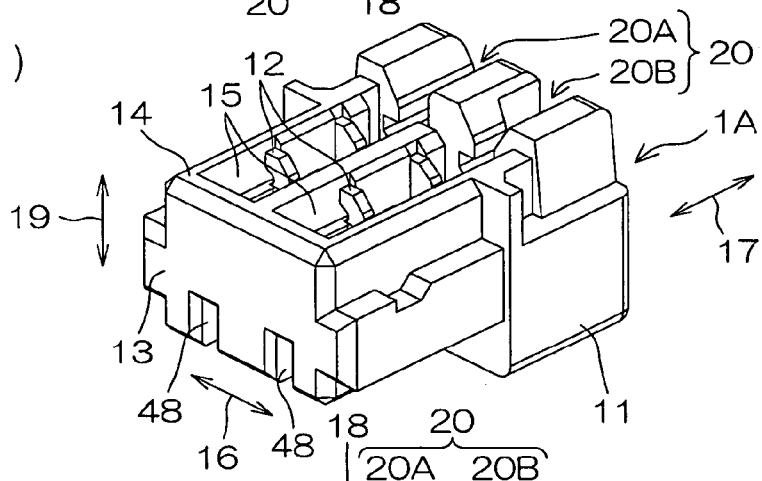
Figure 9C:
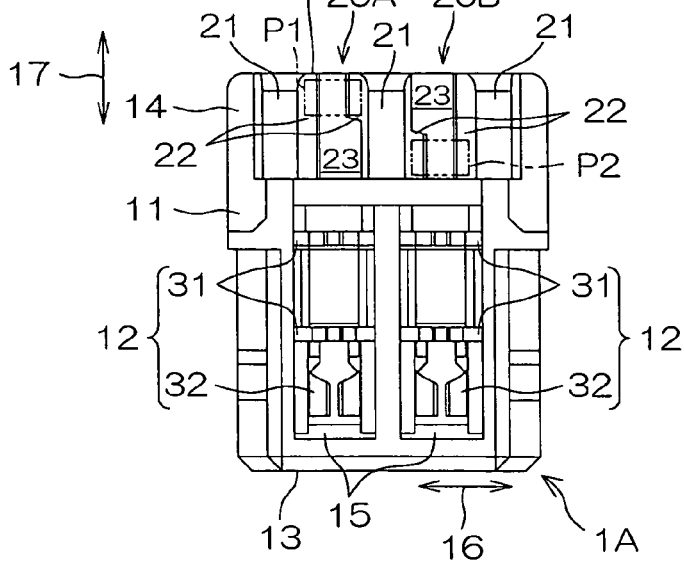

FIG. 9(*a*) to FIG. 9(*c*) are views illustrating the arrangement of the wire-side connector according to a modification of the embodiment above-mentioned. More specifically, FIG. 9(*a*) and FIG. 9(*b*) are perspective views of the wire-side connector as respectively seen in directions similar to those in FIG. 2 and FIG. 3, and FIG. 9(*c*) is a bottom view of the wire-side connector as seen in a direction similar to that in FIG. 4. The wire-side connector 1 above-mentioned shown in FIG. 1 and the like, is of the 11-pole type having 11 insulation displacement contacts 12 and 11 wire holding portions 20 such that 11 insulated wires 2 can be connected in insulation displacement termination. On the other hand, the wire-side connector 1A in FIGS. 9(*a*) and (*b*), is of the 2-pole type having two insulation displacement contacts 12 and two wire holding portions 20 such that two insulated wires 2 can be connected in insulation displacement termination.

Out of two wire holding portions 20, one is a first wire holding portions 20A of which wire hold-down position P1 is nearer to the rear face 18 of the housing 11, and the other is a second wire holding portion 20B of which wire hold-down position P2 is nearer to the insulation displacement contact 12. More specifically, a wire holding piece 21 disposed between and shared with the first wire holding portion 20A and the second wire holding portion 20B, is provided at one tip edge nearer to the rear face 18 with a wire hold-down piece 22 projecting toward the first wire holding portion 20A, and is also provided at the other tip edge nearer to the insulation displacement contact 12 with a wire hold-down piece 22 projecting toward the second wire holding portion 20B. Accordingly, when insulated wires 2 are simultaneously pushed into the first and second wire holding portions 20A, 20B, the wire holding piece 21 at the boundary therebetween is resiliently deformed, at its portion nearer to the rear face 18 of the housing 11, toward the second wire holding portion 20B, and is resiliently deformed, at its front portion nearer to the insulation displacement contact 12, toward the first wire holding portion 20A.

Accordingly, two insulated wires 2 can simultaneously be attached without the housing 11 remarkably deformed. In other words, the housing 11 is not required to be remarkably deformed for simultaneously attaching two insulated wires 2.

Figure 10A:
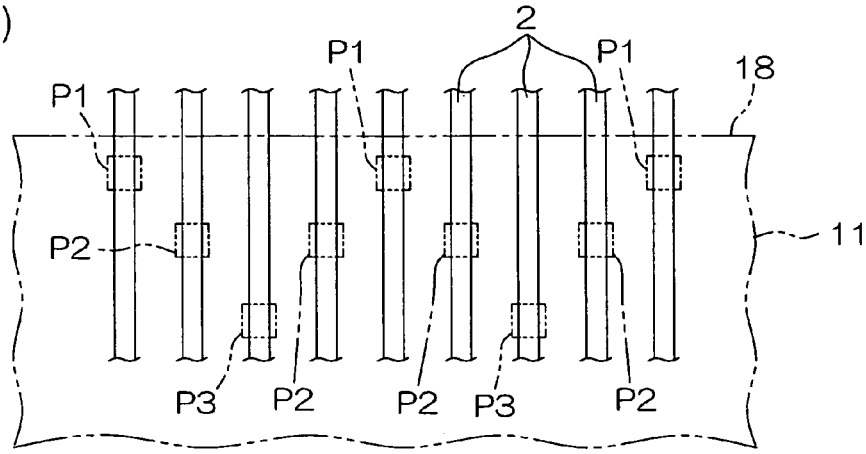
FIG. 10(*a*) and FIG. 10(*b*) are views illustrating the arrangements of wire-side connectors according to another embodiments of the present invention particularly illustrating the wire hold-down positions in the wire-side connector.
Figure 10B:
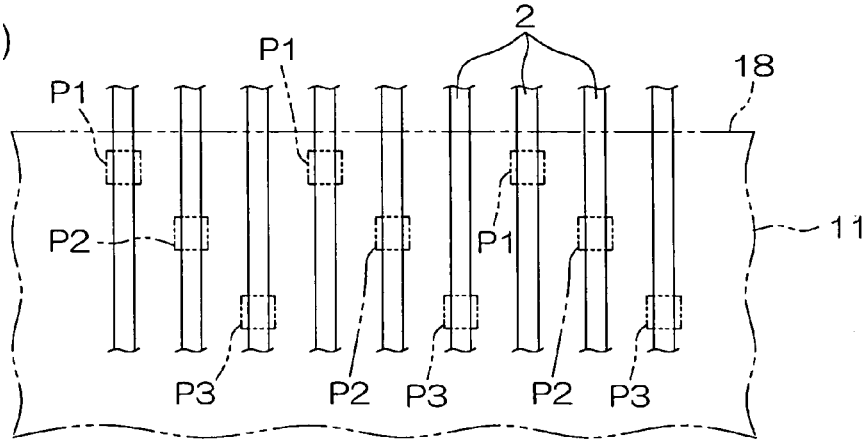

FIG. 10(*a*) and FIG. 10(*b*) are views illustrating the arrangements according to another embodiments of the present invention, showing two examples of the wire hold-down positions in a wire-side connector. In the embodiments above-mentioned, the wire hold-down positions P1, P2 are alternately disposed as misaligned with each other in the axial direction of the insulated wires 2 and arranged in zigzags in two rows. In the examples in FIG. 10(*a*) and FIG. 10(*b*), three-type wire hold-down positions P1, P2, P3 are determined in the axial direction of the insulated wire 2 and arranged in zigzags in three rows.

More specifically, in the example in FIG. 10(*a*), the wire hold-down positions are successively shifted, along the widthwise direction of the housing 11, in a pattern including five positions, i.e., a first wire hold-down position P1 nearer to the rear face 18 of the housing 11, a second wire hold-down position P2 nearer to the front, a third wire hold-down position P3 further nearer to the front, the second wire hold-down position P2 and the first wire hold-down position P1. Then, this pattern is repeated. In the example in FIG. 10(*b*), the wire hold-down positions are successively shifted, along the widthwise direction of the housing 11, in a pattern including three positions, i.e., the first wire hold-down position P1, the second wire hold-down position P2, and the third wire hold-down position P3. Then, this pattern is cyclically repeated.

The arrangements shown in FIG. 10 may further be developed such that a plurality of wire hold-down positions are arranged in zigzags in four or more rows.

Figure 11:
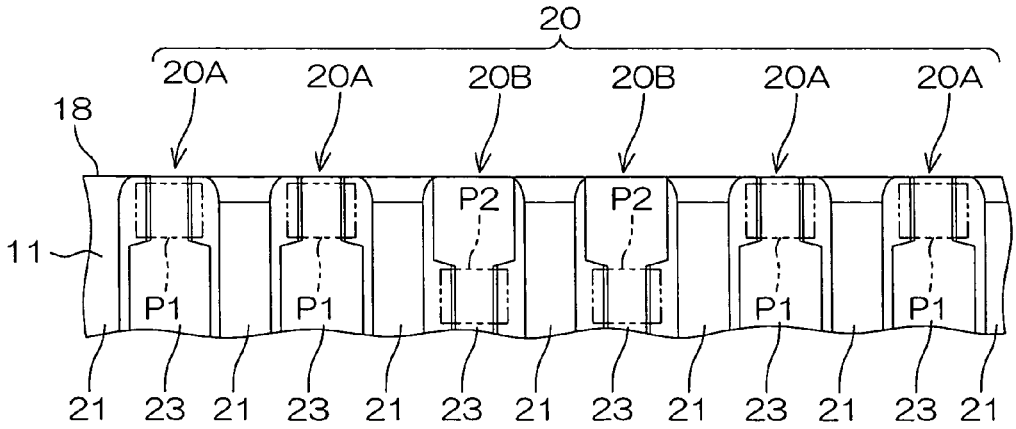
FIG. 11 is a view illustrating the arrangement of a wire-side connector according to a further embodiment of the present invention, particularly illustrating the wire hold-down positions in the wire-side connector.

FIG. 11 is a view illustrating the arrangement according to a further embodiment of the present invention, particularly showing the wire hold-down positions in the wire-side connector. In this embodiment, at one side of a first wire holding portion 20A having a wire hold-down position at a position P1, there is disposed a first wire holding portions 20A having a wire hold-down position at the same position P1. And, at the other side of the first-mentioned first wire holding portion 20A, there is disposed a second wire holding portion 20B having a wire hold-down position at a position P2. Further, at one side of a second wire holding portion 20B having a wire hold-down position at a position P2, there is disposed a second wire holding portion 20B having a wire hold-down position at the same position P2. And, at the other side of the first-mentioned second wire holding portion 20B, there is disposed a first wire holding portion 20A having a wire hold-down position at a position P1. That is, two first wire holding portions 20A and two second wire holding portions 20B are alternately disposed.

In the arrangement above-mentioned, too, one of each pair of wire holding pieces 21 forming a wire holding portion 20, can resiliently be deformed in the wire holding grooves 23 of adjacent wire holding portions 20. Accordingly, likewise in the embodiment shown in FIG. 1 and the like, a plurality of insulated wires can simultaneously be mounted without the housing 11 remarkably deformed.

In the embodiments shown in FIG. 1 to FIG. 11, it is common in the wire-side connectors 1 having three or more poles that, as to three arbitrary adjacent wire holding portions, the wire hold-down positions of at least a pair of wire holding portions are misaligned with each other back and forth along the axial direction 17 of the insulated wires 2.

In the foregoing, various embodiments of the present invention have been discussed, but the present invention may be embodied in other manner. For example, in the embodiments above-mentioned, the description has been made of the wire-side connectors of the 11-pole and 2-pole types. However, no particular restrictions are imposed on the number of poles in the wire-side connector. For example, a similar arrangement may be adopted for a wire-side connector of the 20-pole type.

In the embodiments above-mentioned, the description has been made of a wire-side connector having insulation displacement contacts, but the present invention may also be applied to a connector having contacts of other type such as crimping-type contacts and the like.

In the embodiments above-mentioned, the description has been made of the arrangement in which a plurality of insulation displacement contacts 12 are fixed to the housing 11 as aligned in a straight line along the widthwise direction 16 of the housing 11. However, likewise the wire holding portions 20, the insulation displacement contacts 12 may also be disposed in zigzags or other form. More specifically, the positions of the insulation displacement contacts 12 may be determined such that, in the wire holding portions, the distances between the wire hold-down positions and the insulation displacement parts 31 of the insulation displacement contacts 12, are substantially uniform. According to the arrangement above-mentioned, the distances between the wire hold-down positions and the insulated wires holding positions by the insulation displacement contacts 12, are uniform. This enables a plurality of insulated wires 2 to be held by the housing 11 substantially under the same conditions.

Embodiments of the present invention have been discussed in detail, but these embodiments are mere specific examples for clarifying the technical contents of the present invention. Therefore, the present invention should not be construed as limited to these specific examples. The spirit and scope of the present invention are limited only by the appended claims.

This Application corresponds to Japanese Patent Application No. 2003-340934 filed with the Japanese Patent Office on Sep. 30, 2003, the full disclosure of which is incorporated herein by reference.

What we claim is:

1. An electric connector having a housing provided with a plurality of longitudinally-extending wire holding portions, disposed side by side and extending parallel to one another, for holding insulations of insulated wires of which core wire portions are covered by the insulations:

each wire holding portion comprising: a pair of wire holding pieces disposed as facing each other to form a longitudinally-extending wire holding groove for receiving an insulated wire; a longitudinally-extending, electrically-conductive contact disposed and retained in the wire holding groove; and wire hold-down pieces for guiding, in a vertical direction at a right angle to an axial direction of the insulated wire, the insertion of the insulated wire into the wire holding groove, as well as for preventing the insulated wire from coming off from the wire holding groove, and the plurality of wire holding portions comprising: a first wire holding portion disposed at a first distance from a rear of the connector and having wire hold-down pieces arranged to hold an insulated wire in a wire holding groove at a first wire hold-down position with respect to the axial direction of the insulated wire; and a second wire holding portion disposed at a second distance from the rear of the connector and disposed adjacent to the first wire holding portion, and having wire hold-down pieces arranged to hold an insulated wire in a wire holding groove at a second wire hold-down position different from the first wire hold-down position with respect to the axial direction of the insulated wire; wherein the first distance and the second distance are different are different from one another.

2. An electric connector according to claim 1, wherein the plurality of wire holding portions comprise: the first wire holding portion above-mentioned in plural number; and the second wire holding portion above-mentioned in plural number, and the first and second wire holding portions are alternately disposed in the housing.

3. An electric connector according to claim 1, wherein the plurality of wire holding portions are arranged such that three arbitrary adjacent wire holding portions comprise at least one first wire holding portion above-mentioned and at least one second wire holding portion above-mentioned.

4. An electric connector according to claim 1, wherein each wire hold-down piece has: a guiding inclined face which faces the outside of a wire holding groove and which is arranged to guide an insulated wire into the wire holding groove; and a wire regulating face which faces the inner bottom of the wire holding groove.

5. An electric connector according to claim 1, wherein wire hold-down pieces are formed at each pair of wire holding pieces defining a wire holding groove, and at least one of a pair of wire hold-down pieces of the first wire holding portion, is positionally shifted, in the axial direction of the insulated wire, from at least one of a pair of wire hold-down pieces of the second wire holding portion.

6. An electric connector according to claim 1, wherein the plurality of wire holding portions are arranged such that a wire holding piece is shared with adjacent wire holding portions, and that the shared wire holding piece defines parts of a pair of adjacent wire holding grooves.

7. An electric connector according to claim 1, wherein the plurality of wire holding portions further comprise a third wire holding portion which is disposed adjacent to the first or second wire holding portion, and which has wire hold-down pieces arranged to hold an insulated wire in a wire holding groove at a third wire hold-down position different from the first and second wire hold-down positions with respect to the axial direction of the insulated wire.

8. An electric connector according to claim 7, wherein the plurality of wire holding portions comprise the first wire holding portion above-mentioned in plural number, the second wire holding portion above-mentioned in plural number, and the third wire holding portion above-mentioned in plural number, and the first, second and third wire holding portions are disposed such that the wire holding portions of the same type are not disposed adjacent to each other.

9. An electric connector according to claim 1, further comprising:

contact holding portions which are disposed at inner parts of the wire holding grooves and which hold the contacts coupled and electrically connected to the core wire portions of insulated wires; and the contacts held by the contact holding portions.

10. An electric connector according to claim 9, wherein each of the contacts is an insulation displacement contact having a pair of insulation displacement blades which form a slot for receiving the core wire portion of an insulated wire.

* * * * *

US007011543C1

(12) EX PARTE REEXAMINATION CERTIFICATE (9381st)

United States Patent
Hiramoto et al.

(10) Number: US 7,011,543 C1
(45) Certificate Issued: Oct. 26, 2012

(54) ELECTRIC CONNECTOR

(75) Inventors: Masayuki Hiramoto, Osaka (JP); Takashi Suyama, Osaka (JP); Terumi Nakashima, Osaka (JP)

(73) Assignee: J.S.T. Mfg. Co., Ltd., Chuo-Ku, Osaka-Shi, Osaka (JP)

Reexamination Request:
No. 90/012,389, Jul. 11, 2012

Reexamination Certificate for:

| | |
|---|---|
| Patent No.: | **7,011,543** |
| Issued: | **Mar. 14, 2006** |
| Appl. No.: | **10/950,476** |
| Filed: | **Sep. 28, 2004** |

(30) Foreign Application Priority Data

Sep. 30, 2003 (JP) ..... 2003-340934

(51) Int. Cl.

| | |
|---|---|
| ***H01R 13/58*** | (2006.01) |
| ***H01R 4/24*** | (2006.01) |
| ***H01R 9/03*** | (2006.01) |

(52) U.S. Cl. ..... 439/405; 439/942

(58) Field of Classification Search ..... None
See application file for complete search history.

(56) References Cited

To view the complete listing of prior art documents cited during the proceeding for Reexamination Control Number 90/012,389, please refer to the USPTO's public Patent Application Information Retrieval (PAIR) system under the Display References tab.

*Primary Examiner* — Cheng-Yuan Tseng

(57) ABSTRACT

An electric connector having a housing in which there are disposed, side by side, a plurality of wire holding portions for holding the insulations of insulated wires. Each wire holding portion has: a pair of wire holding pieces disposed as facing each other to form a wire holding groove; and wire hold-down pieces not only for guiding, in the vertical direction, the insertion of the insulated wire into the wire holding groove, but also for preventing the insulated wire from coming off from the wire holding groove. The plurality of wire, holding portions has: a first wire holding portion having wire hold-down pieces at a first wire hold-down position; and a second wire holding portion disposed adjacent to the first wire holding portion, and having wire hold-down pieces at a second wire hold-down position different from the first wire hold-down position.

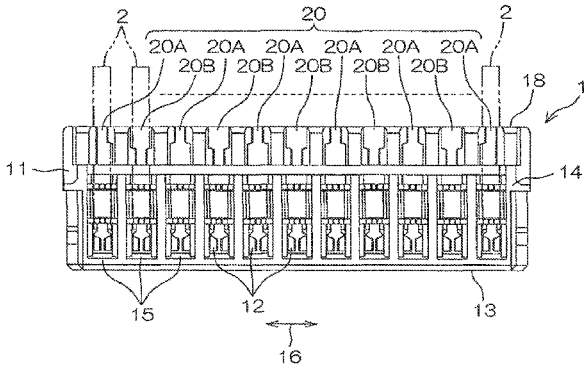

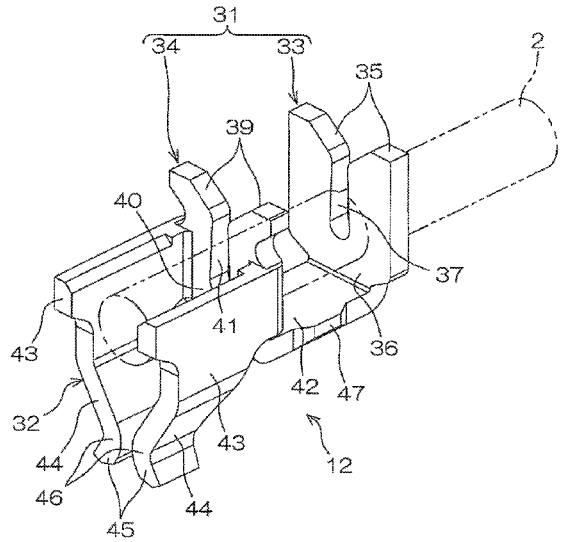

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claim 1 is confirmed.

Claims 2-10 were not reexamined.

* * * * *